US008963660B2

(12) United States Patent
Tanaka et al.

(10) Patent No.: US 8,963,660 B2
(45) Date of Patent: Feb. 24, 2015

(54) ELECTROMAGNETIC RELAY

(75) Inventors: Hiroyasu Tanaka, Yamaga (JP); Yuji Kozai, Kumamoto (JP)

(73) Assignee: Omron Corporation, Kyoto (JP)

( * ) Notice: Subject to any disclaimer, the term of this patent is extended or adjusted under 35 U.S.C. 154(b) by 36 days.

(21) Appl. No.: 13/989,049

(22) PCT Filed: Mar. 23, 2011

(86) PCT No.: PCT/JP2011/057001

§ 371 (c)(1),
(2), (4) Date: Oct. 16, 2013

(87) PCT Pub. No.: WO2012/077362

PCT Pub. Date: Jun. 14, 2012

(65) Prior Publication Data

US 2014/0043120 A1 Feb. 13, 2014

(30) Foreign Application Priority Data

Dec. 6, 2010 (JP) ..... 2010-271826

(51) Int. Cl.

| | |
|---|---|
| ***H01H 51/22*** | (2006.01) |
| ***H01H 51/06*** | (2006.01) |
| ***H01H 50/64*** | (2006.01) |
| *H01H 50/14* | (2006.01) |
| *H01H 50/54* | (2006.01) |

(52) U.S. Cl.

CPC ..... *H01H 51/06* (2013.01); *H01H 50/14* (2013.01); *H01H 50/548* (2013.01); *H01H 50/641* (2013.01); *H01H 51/2209* (2013.01); *H01H 2051/2218* (2013.01)

USPC ..... 335/78; 335/128

(58) Field of Classification Search

CPC ..... H01H 51/06; H01H 50/54; H01H 50/24; H01H 50/26; H01H 50/28; H01H 50/14; H01H 50/14

USPC ..... 335/78, 83, 128–130, 203

See application file for complete search history.

(56) References Cited

U.S. PATENT DOCUMENTS

| | | | | |
|---|---|---|---|---|
| 5,534,834 | A * | 7/1996 | Hendel | 335/78 |
| 6,661,319 | B2 * | 12/2003 | Schmelz | 335/78 |
| 7,659,800 | B2 * | 2/2010 | Gruner et al. | 335/78 |
| 7,710,224 | B2 | 5/2010 | Gruner et al. | |
| 8,330,564 | B2 * | 12/2012 | Miller | 335/78 |

FOREIGN PATENT DOCUMENTS

JP 62071136 A * 4/1987

* cited by examiner

*Primary Examiner* — Bernard Rojas

(74) *Attorney, Agent, or Firm* — Blakely Sokoloff Taylor & Zafman

(57) ABSTRACT

A electromagnetic relay including a plate-shaped pivoting piece (32), one end of which is supported in cantilever state, pivoted by a movable block (40), which reciprocates in the up-down direction on the basis of excitation and demagnetization of an electromagnet block (20) housed within a housing (10, 50), and causes a movable contact (34) formed on the other end of the plate-shaped pivoting piece (32) to make/break contact with an anchored contact (36) formed on the tip section of an anchored contact terminal (35). In particular, the one-end section of the plate-shaped pivoting piece (32) is supported pivotably in cantilever state by the upper end section of a movable contact terminal (31), with a support spring (33) comprising a conductive sheet spring material interposed therebetween.

6 Claims, 8 Drawing Sheets

ELECTROMAGNETIC RELAY

CROSS REFERENCE TO RELATED APPLICATION

This application claims benefit of priority to Japanese Patent Application No. 2010-271826, filed on Dec. 6, 2010 of which full contents are added by herein.

BACKGROUND OF THE INVENTION

The present invention relates to an electromagnetic relay, and particularly to an electromagnetic relay capable of passing a large capacity of current.

Conventionally, as an electromagnetic relay capable of passing a large capacity of current, for example, as shown in FIG. 8 of U.S. Pat. No. 7,710,224 A, there has been an electromagnetic relay provided with a contact button at a tip portion of a triumvirate spring assembly constructed by superimposing three sheet springs in order to reduce electric resistance. The contact button is caused to make and break contact with a contact button to perform electrification.

However, in the foregoing electromagnetic relay, since the triumvirate spring assembly is constructed by superimposing the three conductive sheet springs, not only a number of parts and a number of assembly processes are large but also variation in operating characteristics is easily caused by accumulation of assembling errors.

Moreover, the triumvirate spring assembly needs to fulfill two functions of elastic supporting and electrification. Therefore, for example, if a cross-sectional area of each of the conductive sheet springs is increased to enhance the electrification characteristics, spring loading becomes larger, which requires larger driving energy for driving, so that the enhancement of the electrification performance is disadvantageously limited.

Hence, an object of the present invention is to provide an electromagnetic relay having excellent electrification characteristics, wherein a number of parts and a number of assembling processes are smaller, and variation in operating characteristics does not tend to be caused.

SUMMARY OF THE INVENTION

According to the present invention, an electromagnetic relay in which a plate-shaped pivoting piece supported in a cantilever state at one end portion and pivoted by a movable block, the plate-shaped pivoting piece is adapted to reciprocate in an up-down direction on the basis of excitation and demagnetization of an electromagnet block housed within a housing, and to thereby cause a movable contact provided at another end portion of the plate-shaped pivoting piece to make and break contact with an anchored contact provided at a tip portion of an anchored contact terminal. At an upper end portion of a movable contact terminal, the one end portion of the plate-shaped pivoting piece is pivotably supported in the cantilever state with a support spring interposed therebetween, the support spring being made of a conductive sheet spring material.

According to the present invention, since a circuit can be opened and closed by means of the one plate-shaped pivoting piece, there can be obtained an electromagnetic relay in which the number of parts and the number of assembly processes are smaller and variation in operating characteristics is smaller than those of the conventional example.

Moreover, since the function of the plate-shaped pivoting piece is only electrification, a cross-sectional area can be made larger without considering spring loading, so that the electromagnetic relay having excellent electrification characteristics can be obtained.

In an embodiment of the electromagnetic relay, another end portion of the support spring may be extended up to the other end portion of the plate-shaped pivoting piece, and the movable contact may be caulking-fixed to the other end portion of the plate-shaped pivoting piece and the other end portion of the support spring to be integrated.

According to the present embodiment, since the movable contact is caulking-fixed to the other end portion of the plate-shaped pivoting piece and the other end portion of the support spring to be integrated, electric resistance becomes smaller, so that the electromagnetic relay having high energy efficiency can be obtained.

In another embodiment of the present invention, an elastic tongue piece cut and raised from the support spring is sandwiched by a cut-out portion for engagement of the movable block to operably sustain the plate-shaped pivoting piece by the movable block.

According to the present embodiment, since the plate-shaped pivoting piece is sustained by the movable block by means of the elastic tongue piece of the support spring, the electromagnetic relay having favorable operating characteristics without rattle can be obtained.

In yet another embodiment of the present invention, a bent narrow portion of the support spring is engaged with an engagement receiving portion provided at the one end portion of the plate-shaped pivoting piece.

According to the present embodiment, engaging the engagement receiving portion of the plate-shaped pivoting piece with the bent narrow portion of the support spring prevents the plate-shaped pivoting piece from being displaced horizontally, so that the electromagnetic relay having stable operating characteristics can be obtained.

In a different embodiment of the present invention, one end portion of the support spring is extended up to a lower end portion of the movable contact terminal projected from the housing.

According to the present embodiment, the electromagnetic relay having not only smaller electric resistance but also favorable heat dissipation through the support spring can be obtained.

In another embodiment of the present invention, the upper end portion of the movable contact terminal is folded on a side of the anchored contact terminal, by which the one end portion of the plate-shaped pivoting piece is brought into linear contact with the upper end portion of the movable contact terminal.

According to the present embodiment, since the one end portion of the plate-shaped pivoting piece makes linear contact with an edge portion of the upper end portion of the movable contact terminal, the smooth operating characteristics can be obtained. Particularly, even if the edge portion of the upper end portion of the movable contact terminal is worn away, the upper end portion is inclined, thus bringing about a so-called shaving effect. Thus, a pivoting fulcrum of the plate-shaped pivoting piece does not tend to be displaced, so that stable operating characteristics can be assured over a long period.

In yet another embodiment of the present invention, insulating walls that partition the electromagnet block and the plate-shaped pivoting piece are projected laterally in both side surfaces of the movable block, respectively.

According to the present embodiment, projecting the insulation walls in the movable block makes an insulation distance longer, thereby bringing about an effect that the electromagnetic relay having favorable insulation characteristics can be obtained.

DETAILED DESCRIPTION

An embodiment of an electromagnetic relay according to the present invention will be described in accordance with the accompanying drawings of FIGS. 1A to 8B, wherein references will be made to the figures interchangeably while discussing the electromagnetic relay.

Figure 1B:
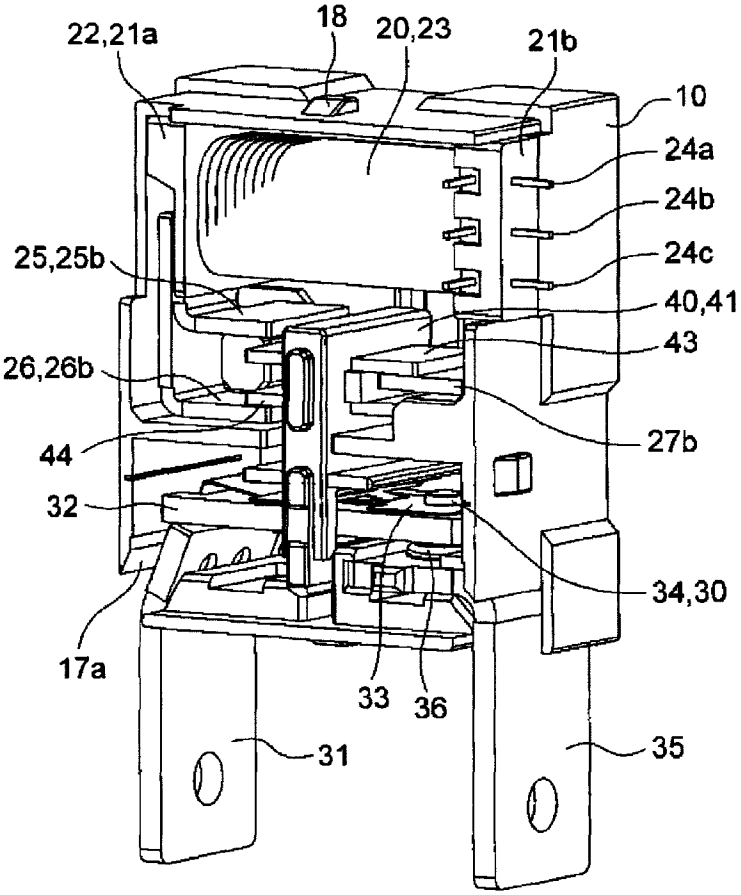
FIGS. 1A and 1B are perspective views showing one embodiment of an electromagnetic relay according to the present invention.
Figure 1A:
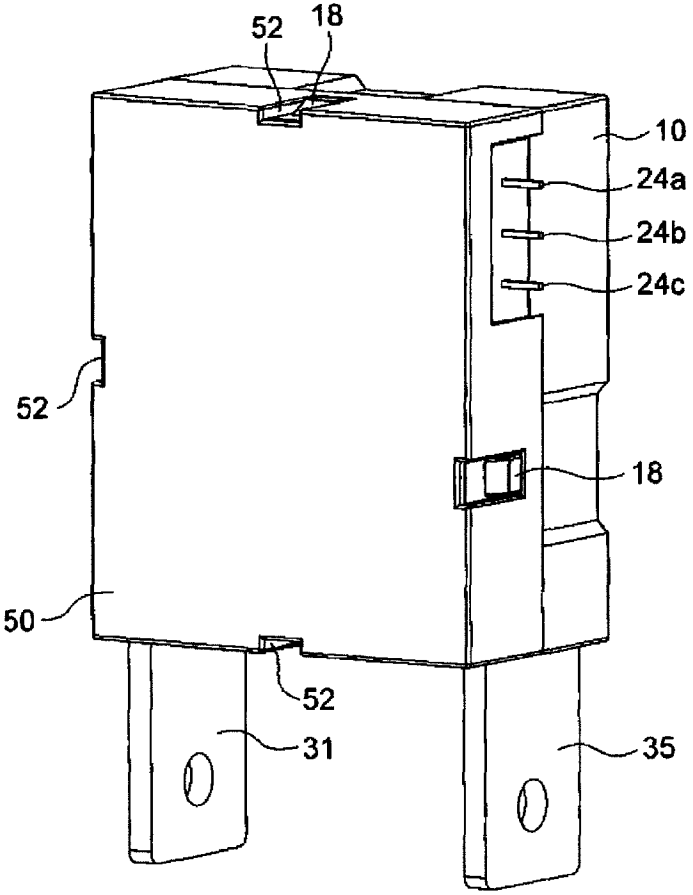
Figure 2:
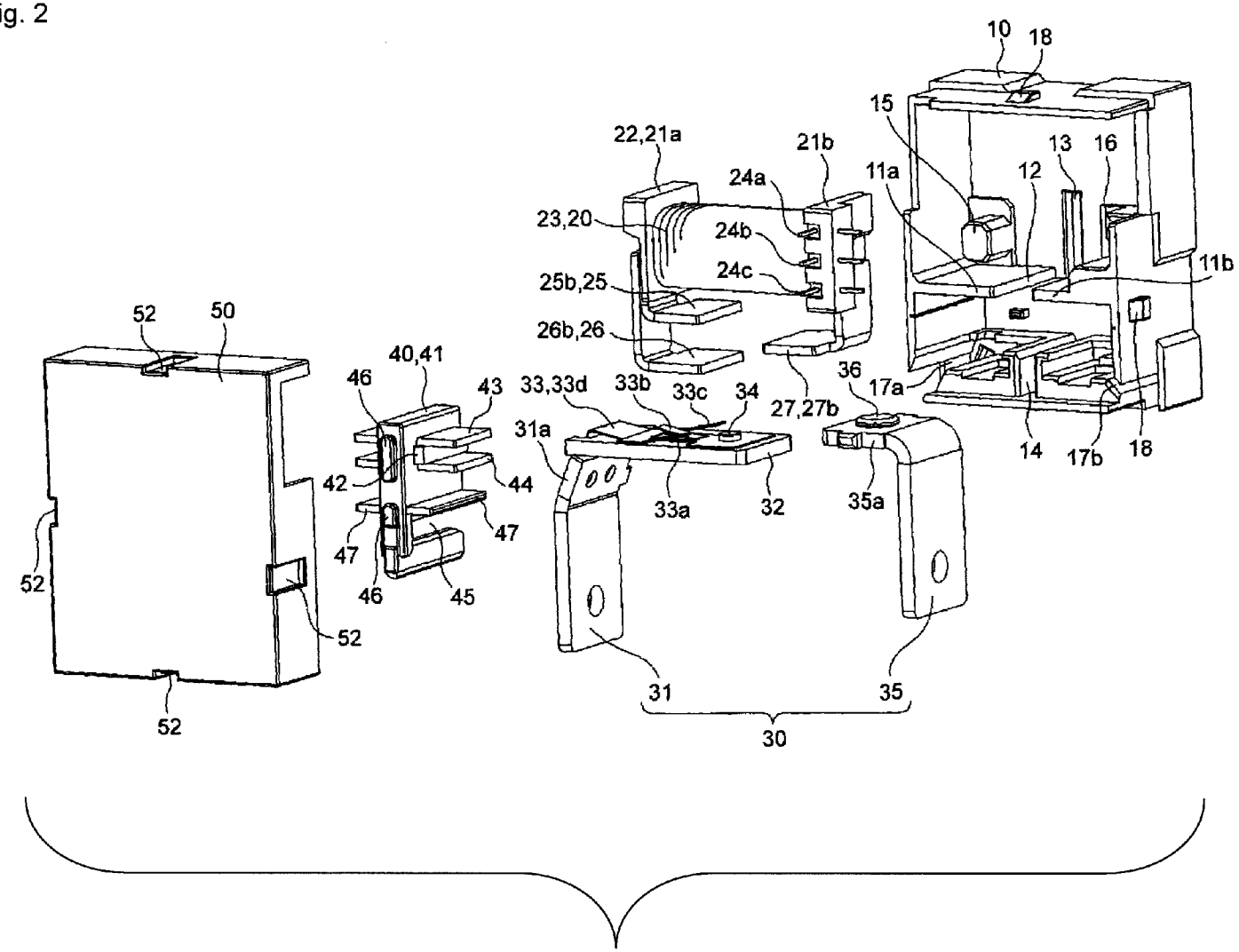
FIG. 2 is an exploded perspective view of the electromagnetic relay shown in FIGS. 1A and 1B.

As shown in FIG. 2, the present embodiment is applied to a self-sustaining electromagnetic relay, which is made up of a substantially box-shaped base 10, an electromagnet block 20 incorporated in the base 10, a contact mechanism portion 30, a movable block 40, and a substantially box-shaped cover 50 fitting on the base 10 to form an enclosed space.

As shown in FIG. 2, in the base 10, a slit for guide 12 is formed between paired partition walls 11*a*, 11*b*, which are projected on the same horizontal plane so as to vertically partition inner surfaces thereof. Moreover, in the base 10, a vertical guide groove 13 communicating with the slit for guide 12 is formed in the inner side surface, and a vertical guide recessed portion 14 is provided immediately under the slit for guide 12. Further, in the base 10, first and second projected portions for positioning 15, 16 are projected in portions located above the partition walls 11*a*, 11*b* in the inner surface, respectively. Furthermore, in the base 10, slits for press-fitting 17*a*, 17*b* are provided at lower corner portions, respectively, and locking protrusions 18 are provided in an outer circumferential surface thereof.

In the electromagnet block 20, a coil 23 is wound around a spool 22 having flange portions 21*a*, 21*b* on both sides, and three coil terminals 24*a*, 24*b*, 24*c* are insert-molded in the flange portion 21*b* of the spool 22. Substantially J-shaped first, second iron cores 25, 26, and a third iron core 27 are inserted from both sides into a through-hole 21*c* (FIG. 5) provided in the spool 22, respectively (FIG. 3) to thereby sandwich an iron core portion 27*a* (FIG. 3) of the third iron core 27 between iron core portions 25*a*, 26*a* (FIG. 3) of the first and second iron cores 25, 26.

Figure 3:
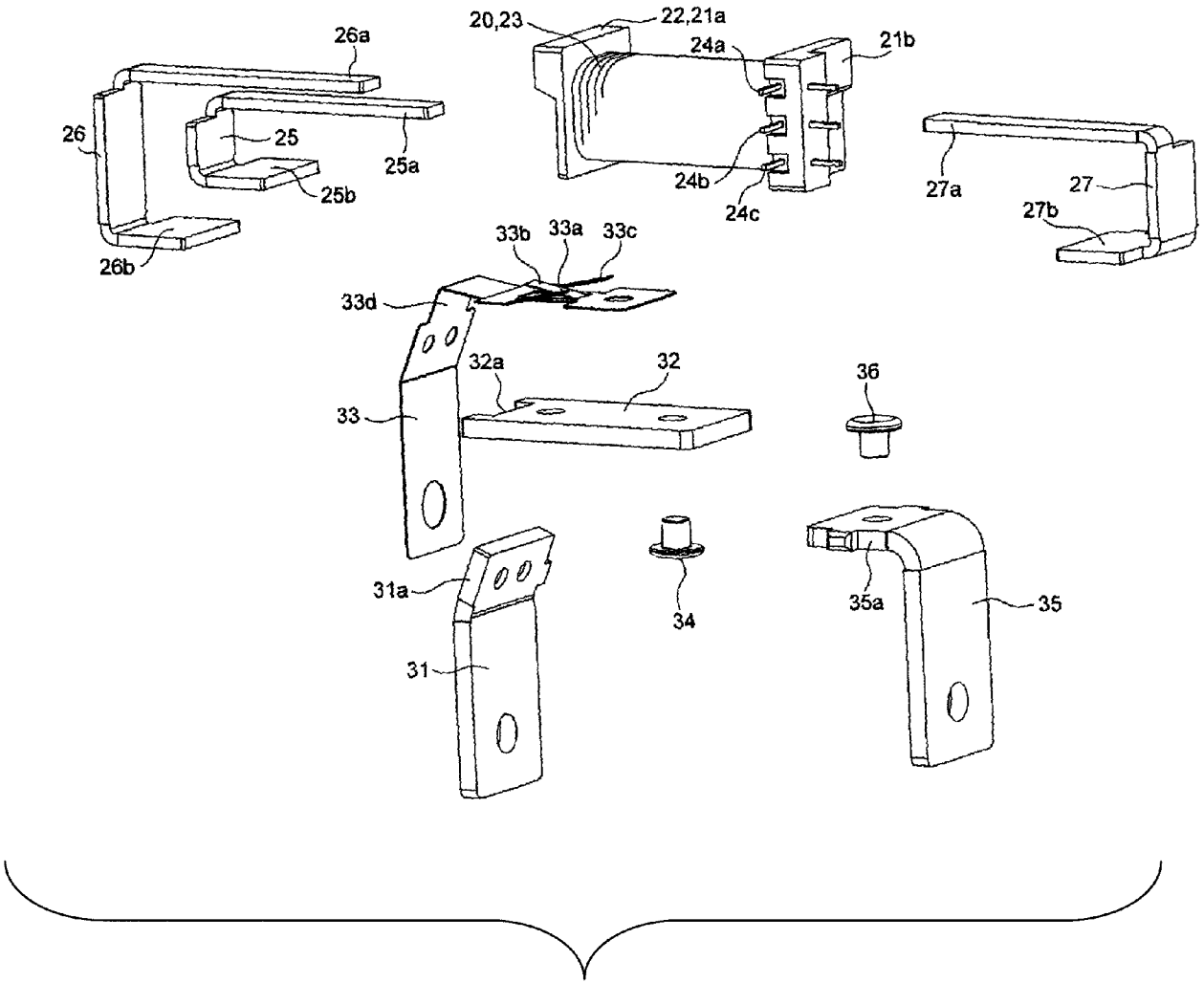
FIG. 3 is a substantial-part enlarged perspective view of the exploded perspective view shown in FIG. 2.

As shown in FIG. 3, the contact mechanism portion 30 is made up of a movable contact terminal 31 with an upper end portion 31 a thereof folded inward, a plate-shaped pivoting piece 32 with one end portion thereof placed on the upper end portion 31*a* of the movable contact terminal 31, a support spring 33 made of a conductive sheet spring material and fixed to outer circumferential surfaces of the movable contact terminal 31 and the plate-shaped pivoting piece 32 to pivotably support the plate-shaped pivoting piece 32, a movable contact 34 caulking-fixed to a free end portion of the plate-shaped pivoting piece 32 and a free end portion of the support spring 33, and an anchored contact terminal 35 with an anchored contact 36 caulking-fixed to a bent horizontal portion 35*a*. The movable contact 34 is arranged so as to be able to make/break contact with the anchored contact 36.

Particularly, the support spring 33 is caulking-fixed along the outer circumferential surfaces of the movable contact terminal 31 and the plate-shaped pivoting piece 32, and the movable contact 34 is caulking-fixed to the free end portion of the plate-shaped pivoting piece 32, thereby being integrated with the plate-shaped pivoting piece 32. Moreover, in the support spring 33, in the vicinity of the movable contact 34, three elastic tongue pieces 33*a*, 33*b*, 33*c* cut and raised in a zigzag shape, and a bent narrow portion 33*d* are provided. Thus, there is an advantage that horizontal displacement of the plate-shaped pivoting piece 32 can be prevented by engaging the narrow portion 33*d* of the support spring 33 with an engagement receiving portion 32*a* provided at the one end portion of the plate-shaped pivoting piece 32.

As shown in FIG. 7, in the movable block 40, paired first and second movable iron pieces 43, 44 sandwiching a permanent magnet 42 vertically are insert-molded in a block body 41, by which both end portions of the first and second movable iron pieces 43, 44 are projected laterally. Moreover, in the block body 41, a cut-out portion 45 to be engaged with the plate-shaped pivoting piece 32 (FIG. 3.) is provided. Furthermore, protrusions for guide 46 are provided in end surfaces on both sides of the block body 41, respectively, and insulating walls 47 are projected laterally in side surfaces on both sides on the same horizontal plane, respectively.

Figure 4:
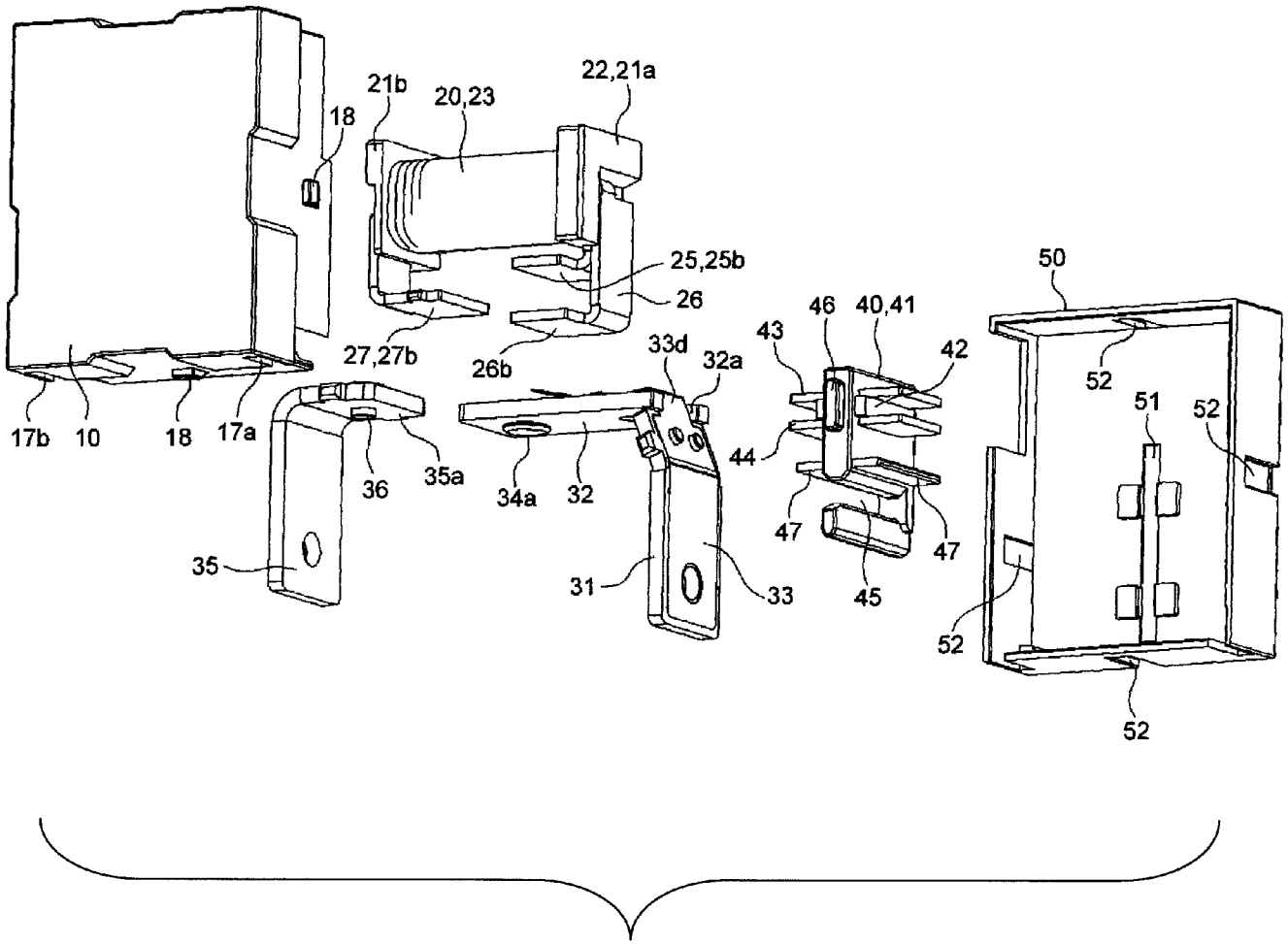
FIG. 4 is an exploded perspective view of the electromagnetic relay shown in FIGS. 1A and 1B seen from a different angle.
Figure 5:
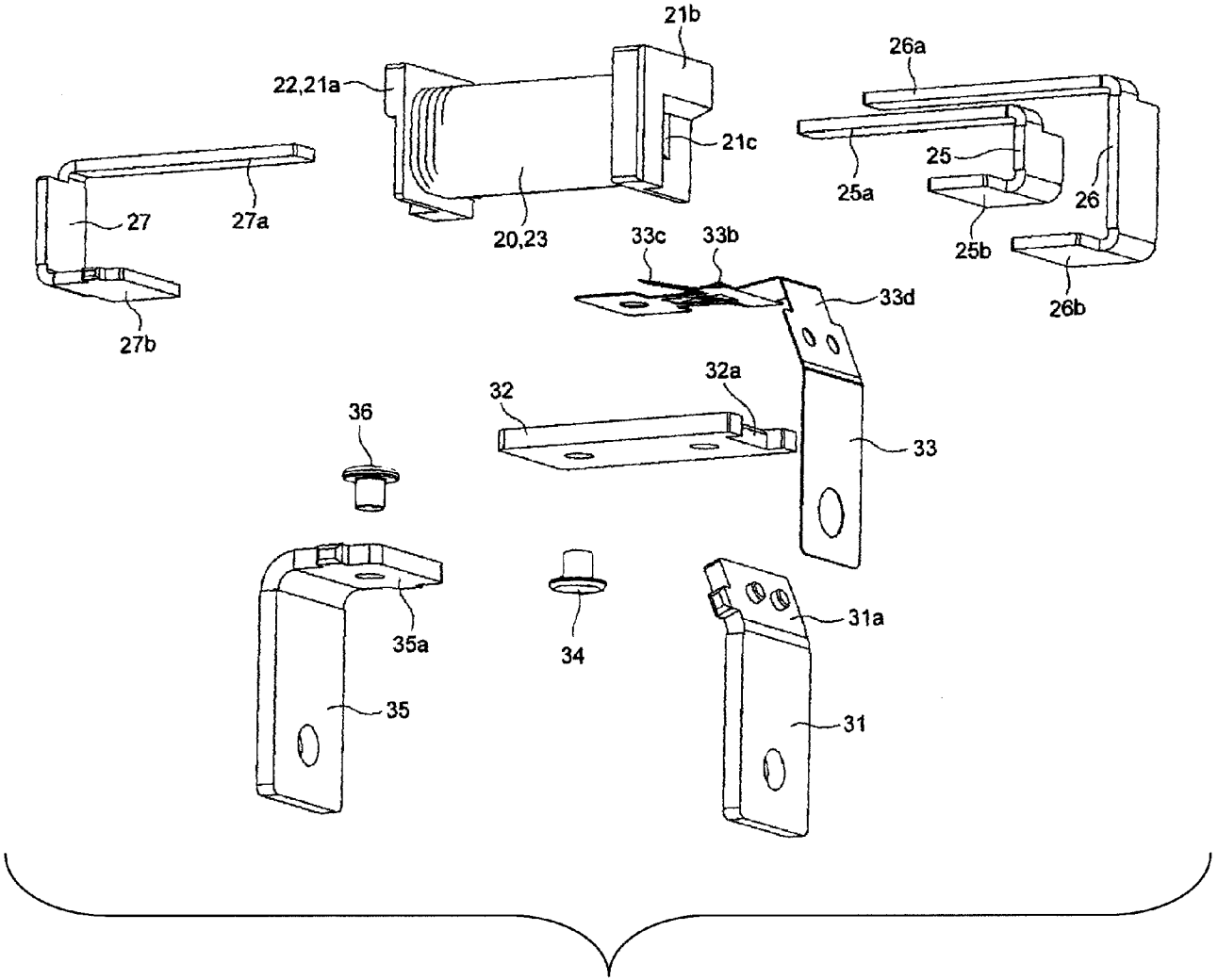
FIG. 5 is a substantial-part enlarged perspective view of the exploded perspective view shown in FIG. 4.
Figure 6B:
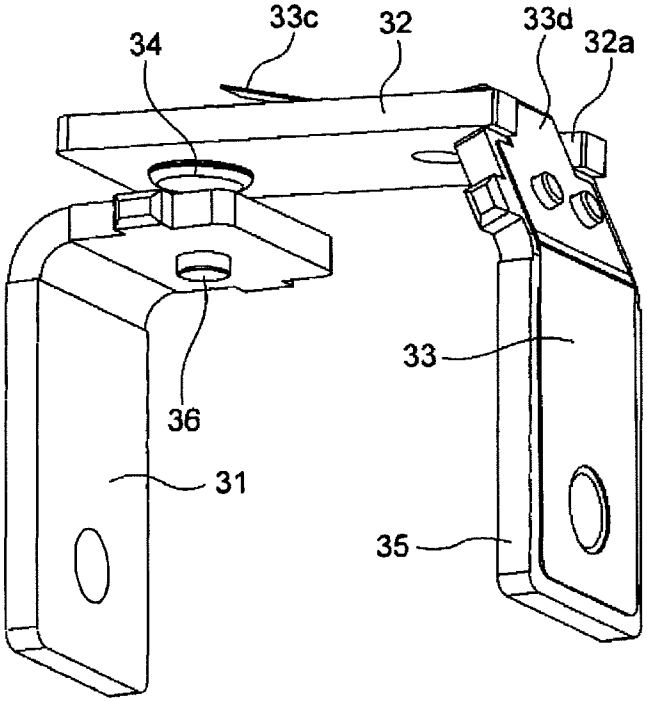
FIGS. 6A and 6B are perspective views showing a contact mechanism shown in FIGS. 1A and 1B.
Figure 6A:
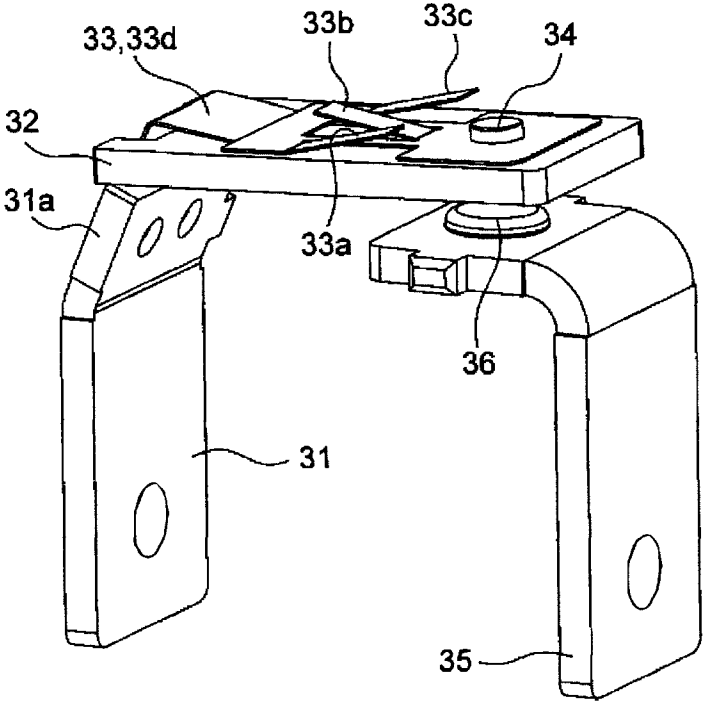
Figure 7B:
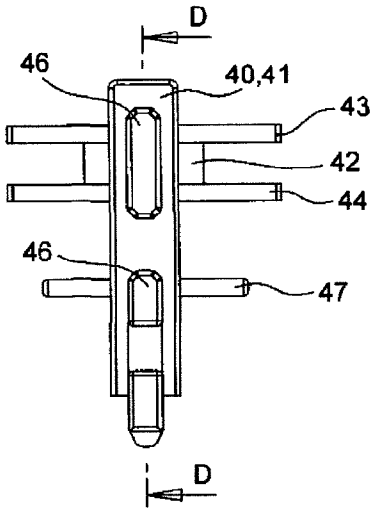
FIGS. 7A, 7B, 7C, and 7D are a front view, a right side view, a cross-sectional view along C-C of FIG. 7A, and a cross-sectional view along D-D in FIG. 7B, respectively.
Figure 7D:
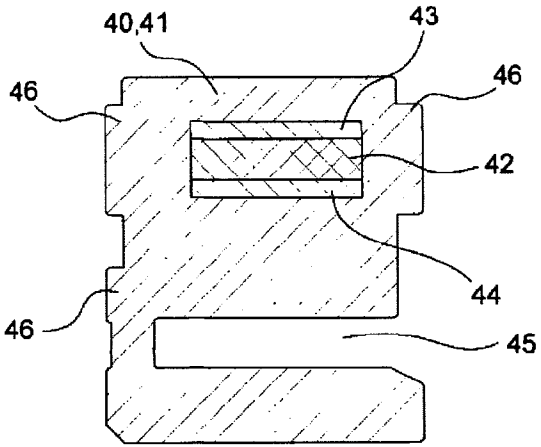
Figure 7A:
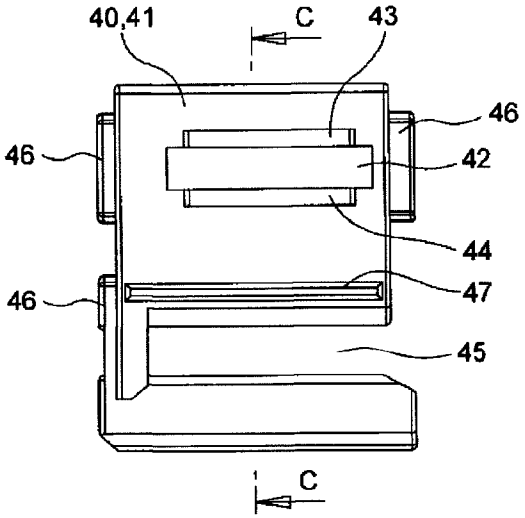
Figure 7C:
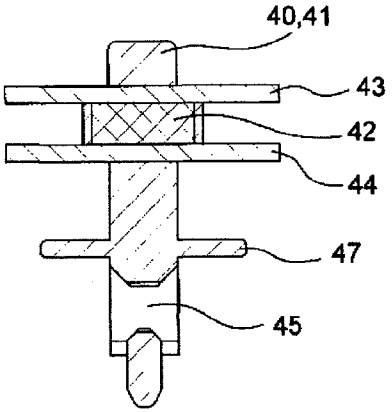

As shown in FIG. 4, the cover 50 has a front shape finable in the base 10, and is provided with a vertical guide groove 51 at a position corresponding to the vertical guide groove 13 (FIG. 2.) of the base 10 and with locking holes 52 in outer circumferential surfaces.

When the foregoing components are assembled, the iron core portions 25*a*, 26*a* of the first and second iron cores 25, 26 and the iron core portion 27*a* of the third iron core 27 are inserted from both the sides of the through-hole 21*c* of the spool 22 with the coil 23 wound, respectively. The iron core portion 27*a* of the third iron core 27 is sandwiched between the iron core portions 25*a*, 26*a* of the first and second iron cores 25, 26 to construct the electromagnet block 20. Subsequently, assembling the electromagnet block 20 into the base 10 allows the first projected portion for positioning 15 of the base 10 to position magnetic pole portions 25*b*, 26*b* of the first and second iron cores 25, 26, and the second projected portion for positioning 16 to position a magnetic pole portion 27*b* of the third iron core 27.

Moreover, the anchored contact terminal 35 is press-fitted in the slit for press-fitting 17*b* of the base 10, and the movable contact terminal 31, which pivotably supports the plate-shaped pivoting piece 32 with the support spring 33 interposed, is press-fitted in the slit for press-fitting 17*a* of the base 10, by which the movable contact 34 is opposed to the anchored contact 36 so as to be able to make/break contact with each other.

The block body 41 of the movable block 40 is fitted in the slit for guide 12 (FIG. 2) of the base 10, which allows the first and second movable iron pieces 43, 44 to be arranged between the first and second magnetic pole portions 25*b*, 26*b*, and the third magnetic pole portion 27*b* to be arranged between the first and second movable iron pieces 43, 44. Furthermore, the cut-out portion 45 of the block body 41 is fitted to the elastic tongue pieces 33*a*, 33*b*, 33*c* (FIG. 3.) cut and raised, which enables the plate-shape pivoting piece 32 to be sustained without rattle in the movable block 40. At this time, the insulating walls 47 are located immediately under the slit for guide 12 (FIG. 12.), which makes an insulation distance longer; so that the electromagnetic relay having high insulation characteristics can be obtained.

Finally, the cover 50 is positioned to the base 10, and the locking protrusions 18 of the base 10 are locked in the locking holes 52 of the cover 50, when the assembling work is completed.

Next, operation of the electromagnetic relay having the above configuration will be described.

Figure 8B:
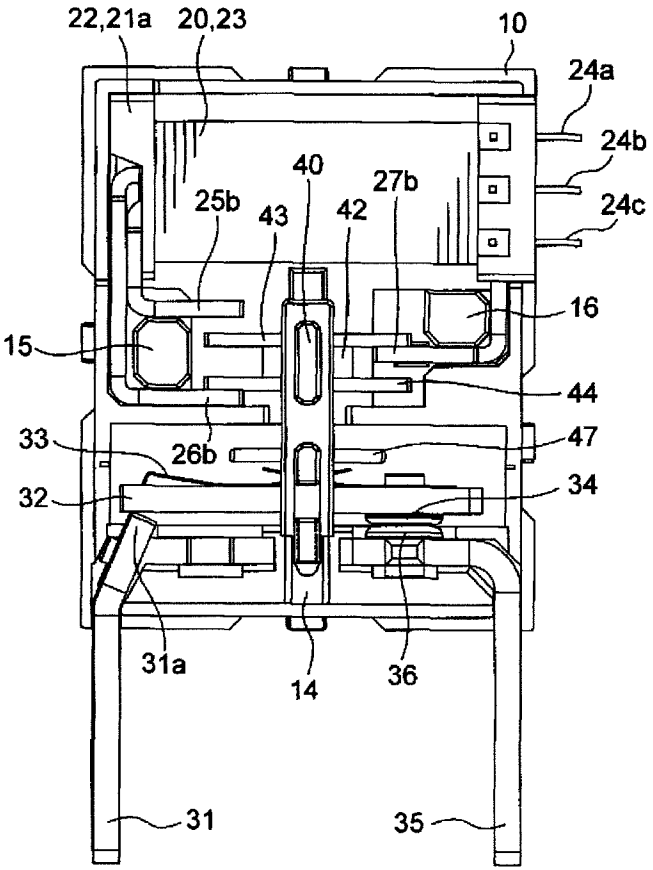
FIGS. 8A, 8B are front cross-sectional views showing states before and after operation of the electromagnetic relay shown in FIGS. 1A and 1B.
Figure 8A:
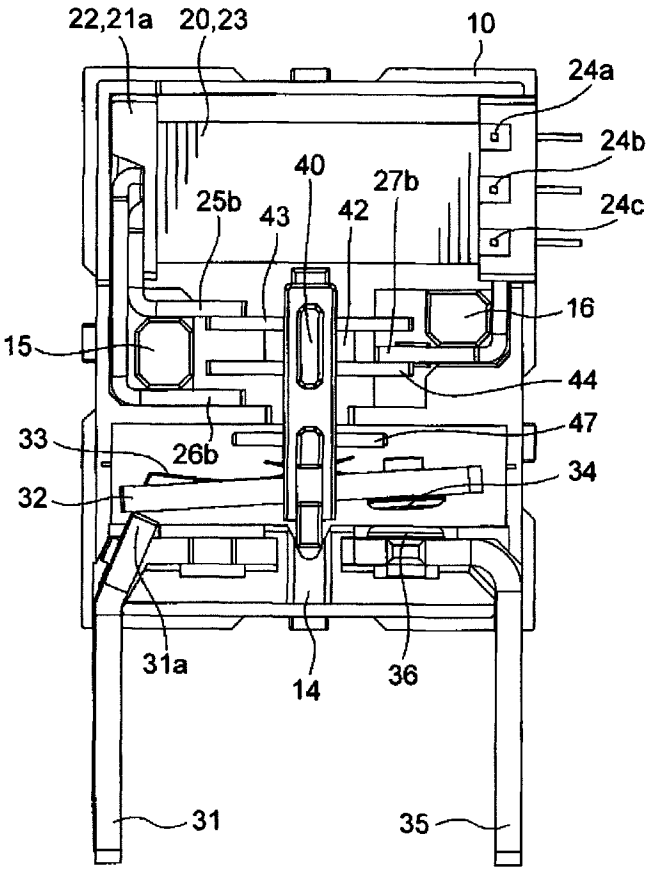

As shown in FIG. 8A, before a voltage is applied to the coil 23 of the electromagnet block 20, the first movable iron piece 43 is attached to the first magnetic pole portion 25*b* by a magnetic force of the permanent magnet 42, and the second movable iron piece 44 is attached to the third magnetic pole portion 27*b* to close a magnetic circuit. Thus, the movable block 40 lifts a tip portion of the plate-shaped pivoting piece 32 upward against a spring force of the support spring 33, so that the movable contact 34 is in a state breaking contact with the anchored contact 36.

When the voltage is applied to the coil 23 in a direction where a magnetic flux of the permanent magnet 42 is cancelled, the first and second movable iron pieces 43, 44 are attracted by the third and second magnetic pole portions 27*b*, 26*b*, respectively. Thus, the plate-shaped pivoting piece 32 is pivoted downward against the spring force of the support spring 33, so that the movable contact 34 abuts on the anchored contact 36, and then, the first and second movable iron pieces 43, 44 are attached to the third, and second magnetic pole portions 27*b*, 26*b*, respectively, to close the magnetic circuit. Even when the application of the voltage to the coil 23 is released, the magnetic force of the permanent magnet 42 allows the movable block 40 to continue sustaining the operating state, thus continuing electrification.

Subsequently, when the voltage is applied in a reverse direction of the foregoing direction, a magnetic force generated inside the electromagnet block 20 and the spring force of the support spring 33 slide and move the movable block 40 upward against the magnetic force of the permanent magnet 42. Thus, the movable contact 34 breaks contact with the anchored contact 36, and then, the first and second movable iron pieces 43, 44 are attached to the first and third magnetic pole portions 25*b*, 27*b*, respectively, and return to the original state.

According to the present embodiment, since the one end portion of the plate-shaped pivoting piece 32 makes linear contact with an edge portion of the upper end portion 31*a* of the movable contact terminal 31, smooth operating characteristics can be obtained.

Moreover, even if the edge portion of the upper end portion 31*a* of the movable contact terminal 31 is worn away, since the upper end portion 31*a* is inclined, a so-called shaving effect can be obtained. This advantageously makes it difficult to displace a pivoting fulcrum of the plate-shaped pivoting piece 32, and assures stable operating characteristics over a long period.

The electromagnetic relay according to the present invention is not limited to the application to the foregoing self-sustaining electromagnetic relay, but obviously, it may be applied to a self-reset electromagnetic relay.

There has thus been shown and described an attachment structure of an electromagnetic relay which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimd is:

1. An electromagnetic relay comprising:

a plate-shaped pivoting piece supported in a cantilever state at one end portion and pivoted by a movable block, the plate-shaped pivoting piece adapted to reciprocate in an up-down direction on a basis of excitation and demagnetization of an electromagnet block housed within a housing, a movable contact having a movable contact terminal provided at another end portion of the plate-shaped pivoting piece configured to make and break contact with an anchored contact provided at a tip portion of an anchored contact terminal in response to reciprocation of said plate-shaped pivoting piece, an elastic tongue piece cut and raised from a support spring, and sandwiched by a cut-out portion for engagement of the movable block, the elastic tongue piece operably sustaining the plate-shaped pivoting piece by the movable block, wherein the one end portion of the plate-shaped pivoting piece is pivotably supported in the cantilever state with the support spring interposed between the one end portion and an upper end portion of the movable contact terminal, the support spring being made of a conductive sheet spring material.

2. The electromagnetic relay according to claim 1, wherein another end portion of the support spring is extended up to the other end portion of the plate-shaped pivoting piece, and the movable contact is caulking-fixed to the other end portion of the plate-shaped pivoting piece and the other end portion of the support spring.

3. The electromagnetic relay according to claim 1, wherein the support spring comprises a bent narrow portion engaged with an engagement receiving portion, and the engagement receiving portion is provided at the one end portion of the plate-shaped pivoting piece.

4. The electromagnetic relay according to claim 1, wherein one end portion of the support spring is extended up to a lower end portion of the movable contact terminal projected from the housing.

5. The electromagnetic relay according to claim 1, wherein the upper end portion of the movable contact terminal is folded on a side of the anchored contact terminal, linearly contacting the one end portion of the plate-shaped pivoting piece with the upper end portion of the movable contact terminal.

6. The electromagnetic relay according to claim 1 further comprising:

insulating walls partitioning the electromagnet block and the plate-shaped pivoting piece, the insulating walls projected laterally in both side surfaces of the movable block.

* * * * *